US009330627B2

(12) United States Patent
Syu et al.

(10) Patent No.: US 9,330,627 B2
(45) Date of Patent: May 3, 2016

(54) SELF-ADAPTIVE MULTI-REGION COMMON VOLTAGE REGULATION SYSTEM AND METHOD

(71) Applicant: SHENZHEN CHINA STAR OPTOELECTRONICS TECHNOLOGY CO., LTD., Shenzhen, Guangdong (CN)

(72) Inventors: Shen-Sian Syu, Shenzhen (CN); Chih Hao Wu, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/240,381

(22) PCT Filed: Jan. 21, 2014

(86) PCT No.: PCT/CN2014/070954

§ 371 (c)(1),
(2) Date: Jul. 31, 2014

(87) PCT Pub. No.: WO2015/100814

PCT Pub. Date: Jul. 9, 2015

(65) Prior Publication Data

US 2015/0206494 A1 Jul. 23, 2015

(30) Foreign Application Priority Data

Dec. 31, 2013 (CN) ..... 2013 1 0753571

(51) Int. Cl.
*G09G 3/36* (2006.01)

(52) U.S. Cl.
CPC ..... *G09G 3/3696* (2013.01); *G09G 2320/0233* (2013.01); *G09G 2320/0247* (2013.01); *G09G 2320/0693* (2013.01); *G09G 2360/145* (2013.01)

(58) Field of Classification Search
CPC ..... G09G 2320/0247; G09G 2320/0233; G09G 2320/0693
See application file for complete search history.

(56) References Cited

U.S. PATENT DOCUMENTS 7,119,815 B1 * 10/2006 Cahill, III ..... G09G 5/00 345/629
8,184,113 B2 * 5/2012 Huang ..... G09G 3/3611 345/212

(Continued)

FOREIGN PATENT DOCUMENTS

CN 1462991 A 12/2003
CN 1527275 A 9/2004

(Continued)

OTHER PUBLICATIONS

International Search Report and Written Opinion dated Oct. 10, 2014, issued to International Application No. PCT/CN2014/070954.

*Primary Examiner* — Sanjiv D Patel
(74) *Attorney, Agent, or Firm* — Stein IP, LLC

(57) ABSTRACT

The present disclosure discloses a system of self-adaptively adjusting Multi-area common voltage, comprising a plurality of photosensitive devices, for sensing luminous quantity from the different areas so as to obtain and transmit flicker values corresponding to the different areas; a multiplexing element, connected with the plurality of photosensitive devices; a calculation and comparison unit, for continuously receiving the flicker values which are sensed by the plurality of photosensitive devices in a time sequence, calculating actual display condition, and comparing the actual display condition with an optimal display condition; and an common voltage adjusting and outputting unit, connected with the calculation and comparison unit, for adjusting the value of the current output common voltage if the optimal display condition is not met and remaining the value of the current output common voltage unchanged if the optimal display condition is met. The present disclosure can achieve automatically adjustment of the common voltage and thus increase the productivity.

7 Claims, 4 Drawing Sheets

(56) References Cited

U.S. PATENT DOCUMENTS

| | | | | |
|---|---|---|---|---|
| 2005/0116910 | A1* | 6/2005 | Lee | G09G 3/3648 345/87 |
| 2005/0218302 | A1* | 10/2005 | Shin | G02F 1/13318 250/214 R |
| 2007/0057975 | A1* | 3/2007 | Oh | G09G 3/3648 345/690 |
| 2007/0063957 | A1* | 3/2007 | Awakura | G02F 1/13318 345/98 |
| 2007/0139343 | A1* | 6/2007 | Wang | G09G 3/3655 345/98 |
| 2007/0236484 | A1* | 10/2007 | Oh | G09G 3/3614 345/204 |
| 2010/0033414 | A1* | 2/2010 | Jeong | G09G 3/3655 345/89 |

FOREIGN PATENT DOCUMENTS

| | | | |
|---|---|---|---|
| CN | 101082710 | A | 12/2007 |
| CN | 101086569 | A | 12/2007 |
| CN | 101221303 | A | 7/2008 |
| CN | 101320541 | A | 12/2008 |
| CN | 102013236 | A | 4/2011 |
| FR | 2 789 836 | A1 | 8/2000 |
| JP | 2001-194233 | A | 7/2001 |
| JP | 2004-191588 | A | 7/2004 |

* cited by examiner

SELF-ADAPTIVE MULTI-REGION COMMON VOLTAGE REGULATION SYSTEM AND METHOD

FIELD OF THE INVENTION

The present disclosure relates to the field of display technologies, and particularly, to a system and method for self-adaptively adjusting multi-area common voltage.

BACKGROUND OF THE INVENTION

With the increasing of the sizes of the liquid crystal displays produced, the uniformity of a display panel becomes a markedly concerned problem. Multi-area common voltages are usually determined for a panel, and the uniformity is improved by adjusting the voltages respectively. However, when adjusting the common voltage of certain area to reduce flicker of display, respective different common voltages applied on the plurality of areas will influence on the common voltages of other areas. Thus it is difficult to regulate the common voltages of all the areas to the optimal value that can eliminate the flicker.

For example, in FIG. 1, the flicker conditions of the areas previously divided in the display panel 102 are obtained through a photosensitive apparatus 101 firstly. For example, if the condition of an area F1 is the worst, then the common voltage of the area F1 is adjusted firstly, so that the value of flicker is the minimum. Then, the common voltage of an area F2, for example, is adjusted. However, the changed common voltage of the area F2 will influence on the adjusted voltage of the area F1, so that the previously adjusted flicker condition of the area F2 is not in the optimal state again. For achieving the overall effect of panel display, the regulation needs to be repeatedly performed in this way. It is a very tedious and time-consuming process. Moreover, this requires that the engineers who debug the panel are experienced.

Therefore, aiming at the above-mentioned problem, there is a need to provide a system or a technical solution capable of self-adaptively adjusting the common voltages of a display panel according to flicker degrees of a plurality of areas so as to eliminate the flicker of the overall picture.

SUMMARY OF THE INVENTION

For solving the above-mentioned technical problems, the present disclosure provides a system of adaptively adjusting Multi-area common voltage, comprising:

a plurality of photosensitive devices, arranged near different areas of a display panel, for sensing luminous quantity from the different areas so as to obtain and transmit flicker values corresponding to the different areas;

a multiplexing element, connected with the plurality of photosensitive devices so as to receive the flicker values transmitted by the plurality of photosensitive devices and transmit one of the flicker values at one moment;

a calculation and comparison unit, for continuously receiving the flicker values which are sensed by the plurality of photosensitive devices and transmitted by the multiplexing element in a time sequence, calculating the actual display condition determined by the plurality of flicker values, and comparing the actual display condition with the optimal display condition, so as to judge whether the optimal display condition is met or not; and a common voltage adjusting and outputting unit, connected with the calculation and comparison unit, for adjusting the value of the current output common voltage if the optimal display condition is not met, and remaining the value of the current output common voltage unchanged if the optimal display condition is met.

According to an embodiment of the present disclosure, different areas of the display panel are assigned different weights, and the actual display condition determined by the plurality of flicker values is calculated according to the weights.

According to an embodiment of the present disclosure, the actual display condition is calculated according to the following equation:

$$J = \sum_{i=0}^{M} W_i \times FLICKER_i$$

wherein J represents the display condition, $W_i$ represents the weight of area i, $FLICKER_i$ represents the flicker value corresponding to area i, and M represents the number of the divided areas of the display panel.

According to an embodiment of the present disclosure, the weights vary from the positions of the areas.

According to an embodiment of the present disclosure, the common voltage adjusting and outputting unit comprises a common voltage buffer, for storing a common voltage value to be output, and providing the value after digital-to-analog conversion to common electrode ends corresponding to the different areas of the display panel.

According to an embodiment of the present disclosure, when the comparison result indicates that the difference between the actual display condition and the optimal display condition exceeds a first preset value, the value of the output common voltage corresponding to an area with the maximum weight is first adjusted;

when the comparison result indicates that the difference between the actual display condition and the optimal display condition is less than a second preset value, the common voltage output value corresponding to the area with the minimum weight is first adjusted; and when the comparison result indicates that the difference between the actual display condition and the optimal display condition is between the first preset value and the second preset value, the value of the output common voltage corresponding to an area with a medium weight is first adjusted.

According to another aspect of the present disclosure, a method of self-adaptive adjusting Multi-area common voltage is also provided, and the method comprises the following steps:

sensing luminous quantity from different areas to obtain and transmit flicker values corresponding to different areas;

receiving the flicker values corresponding to the plurality of areas, and transmitting one of the flicker values at one moment;

continuously receiving the sensed flicker values in a time sequence, calculating the display condition determined by the plurality of flicker values, comparing the display condition with the optimal display condition, so as to judge whether the optimal display condition is met or not; and adjusting the current common voltage value if the optimal display condition is not met, and remaining the current common voltage output value unchanged if the optimal display condition is met.

According to an embodiment of the method, different areas on the display panel are assigned different weights, and the display condition determined by the plurality of flicker values is calculated based on the weights.

According to an embodiment of the method, the output common voltage is adjusted by changing the voltage value stored in the voltage buffer.

According to an embodiment of the method, the output common voltage is adjusted by changing voltage values input to a common voltage driver circuit.

According to an embodiment of the method, if the comparison result indicates that the difference between the actual display condition and the optimal display condition exceeds a first preset value, the common voltage output value corresponding to an area with the maximum weight is first adjusted;

if the comparison result indicates that the difference between the actual display condition and the optimal display condition is less than a second preset value, the common voltage output value corresponding to the area with the minimum weight is first adjusted; and if the comparison result indicates that the difference between the actual display condition and the optimal display condition is between the first preset value and the second preset value, the common voltage output value corresponding to an area with a medium weight is preferably adjusted.

The present disclosure benefits from the following. Since the common voltages are automatically adjusted based on the flicker conditions, a tedious manual work link can reduced, the production efficiency be improved, and the cost be saved.

Other features and advantages of the present disclosure will be illustrated in the following description, and are partially obvious from the description or understood through implementing the present disclosure. The objectives and other advantages of the present disclosure may be realized and obtained through the structures specified in the description, claims and accompanying drawings.

BRIEF DESCRIPTION OF THE DRAWINGS

The accompanying drawings are provided for a further understanding of the present disclosure, constitute a part of the description, and are used for interpreting the present disclosure together with the embodiments of the present disclosure, rather than limiting the present disclosure. In the accompanying drawings.

DETAILED DESCRIPTION OF THE EMBODIMENTS

The embodiments of the present disclosure will be illustrated in detail in conjunction with the accompanying drawings and embodiments, and thus how to use technical means to solve the technical problems and the implementation process of achieving the technical effects may be fully understood and accordingly implemented. It should be noted that as long as conflicts are avoided, all embodiments in the present disclosure and all features in all the embodiments may be combined together, and the formed technical solutions are within the protection scope of the present disclosure.

Figure 1:
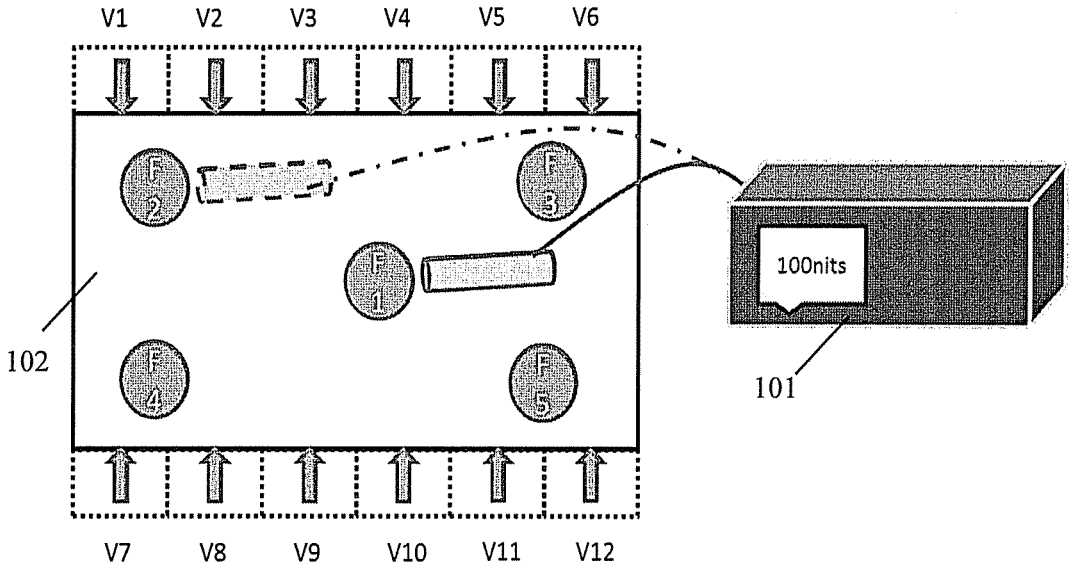
FIG. 1 shows a schematic diagram of manually adjusting common voltage values by using a photosensitive instrument only in the prior art.
Figure 2:
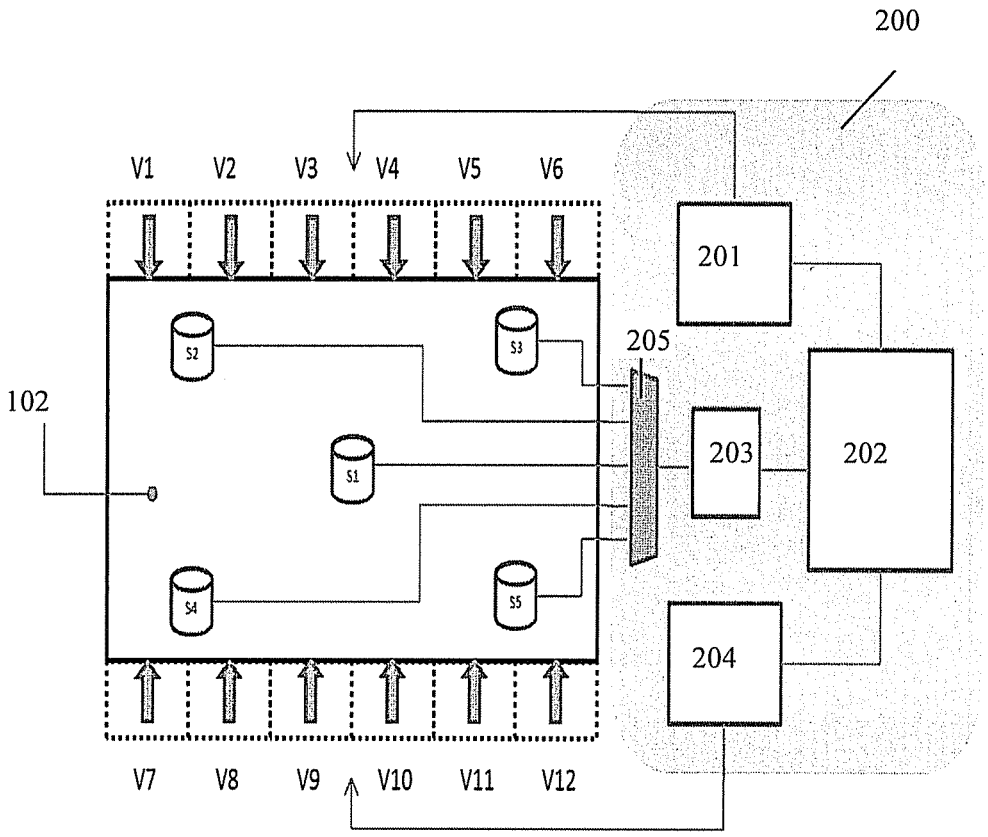
FIG. 2 shows a schematic diagram of a system of automatically adjusting common voltage values according to an embodiment of the present disclosure.

As shown in FIG. 2, there is provided a schematic diagram of a common voltage automatic regulation system 200 designed according to the principle of the present disclosure. A plurality or areas, or referred to as a plurality of representative points S1, S2 . . . are divided on a display panel 102. The areas correspond to different common voltage driving inputs (V1, V2 . . . ) respectively. For example, the flicker value of the area S2 can be changed by adjusting the value of V1 or V2. A multiple of photosensitive devices are mounted near the different areas (S1, S2 . . . ), for sensing luminous quantity from the different areas, so as to obtain flicker values corresponding to the different areas. The photosensitive devices transmit the obtained flicker values to a multiplexing element 205.

The multiplexing element 205 is connected with the plurality of photosensitive devices. The multiplexing unit 205 can receive the flicker values transmitted by the plurality of photosensitive devices, and can choose to transmit one of the flicker values to a central processing unit or a calculating comparison unit 202 at a moment The flicker value transmitted by the multiplexing unit is an analog quantity, but the calculation and comparison unit 202 processes a digital quantity. Therefore, an analog-to-digital conversion unit 203 needs to be arranged between the multiplexing unit and the calculation and comparison unit 202.

Figure 3:
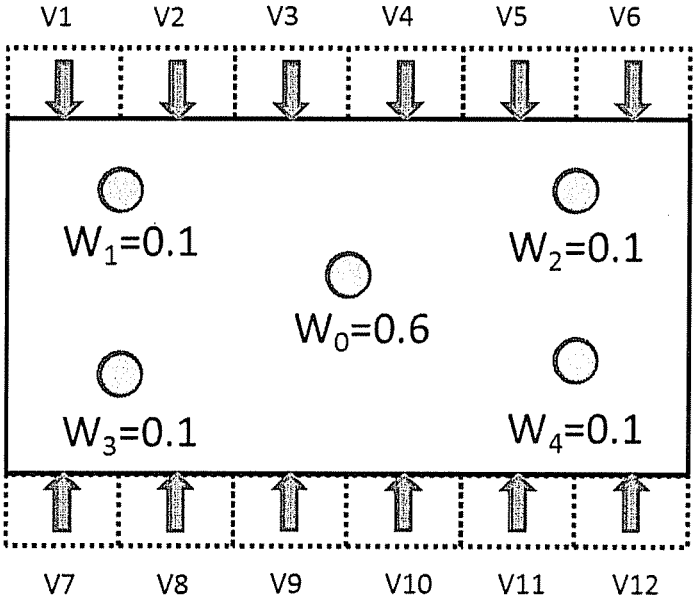
FIG. 3 shows an example of assigning different weights to the different areas of a display panel.

The calculation and comparison unit 202 continuously receives the flicker values sensed by the plurality of photosensitive devices and transmitted by the multiplexing element 205 in a time sequence, calculates the actual display condition determined by the plurality of flicker values, and compares the actual display condition with the optimal display condition so as to judge whether the optimal display condition is met or not;

The different areas on the display panel are assigned different weights, based on which the actual display condition determined by the plurality of flicker values is calculated. FIG. 3 shows a schematic diagram of the different weights assigned to the different areas on the display panel. It can be seen that the weights of the areas at the two sides of the panel are slightly low, for example, $W_1$=0.1, and the weight at the center of the panel is the highest, $W_0$=0.6. This is because the area at the center of the panel has the greatest influence on vision in display. Certainly, other weight assignment conditions may also exist, and thus the different weight assignments all fall into the protection scope of the present disclosure.

In an example of the present disclosure, the actual display condition can be calculated according to the following equation:

$$J = \sum_{i=0}^{M} W_i \times FLICKER_i$$

wherein J represents the actual display condition, $W_i$ represents the weight of area i, $FLICKER_i$ represents the flicker value corresponding to area, and M represents the number of the divided areas of the display panel.

The common voltage adjusting and outputting units 201 and 204 are connected with the calculation and comparison unit 202. The value of the current output common voltage is adjusted if the optimal display condition is not met, and the value of the current output common voltage remains unchanged if the optimal display condition is met.

In an example, the voltage can be adjusted in the following manner:

when the comparison result indicates that the difference between the actual display condition and the optimal display condition exceeds a first preset value, the value of the output common voltage corresponding to the area with the highest weight is first adjusted;

when the comparison result indicates that the difference between the actual display condition and the optimal display condition is less than a second preset value, the value of the output common voltage corresponding to the area with the lowest weight is first adjusted; and when the comparison result indicates that the difference between the actual display condition and the optimal display condition is between the first preset value and the second preset value, the value of the output common voltage corresponding to an area with a medium weight is first adjusted.

In an example, the common voltage adjusting and outputting units 201 and 204 comprise a common voltage buffer. A storage area is arranged in the buffer, for storing the value of the common voltage to be output. When an output order is issued, the value of the common voltage to be output after digital-to-analog conversion is provided to common electrode ends corresponding to the different areas of the display panel.

Figure 4:
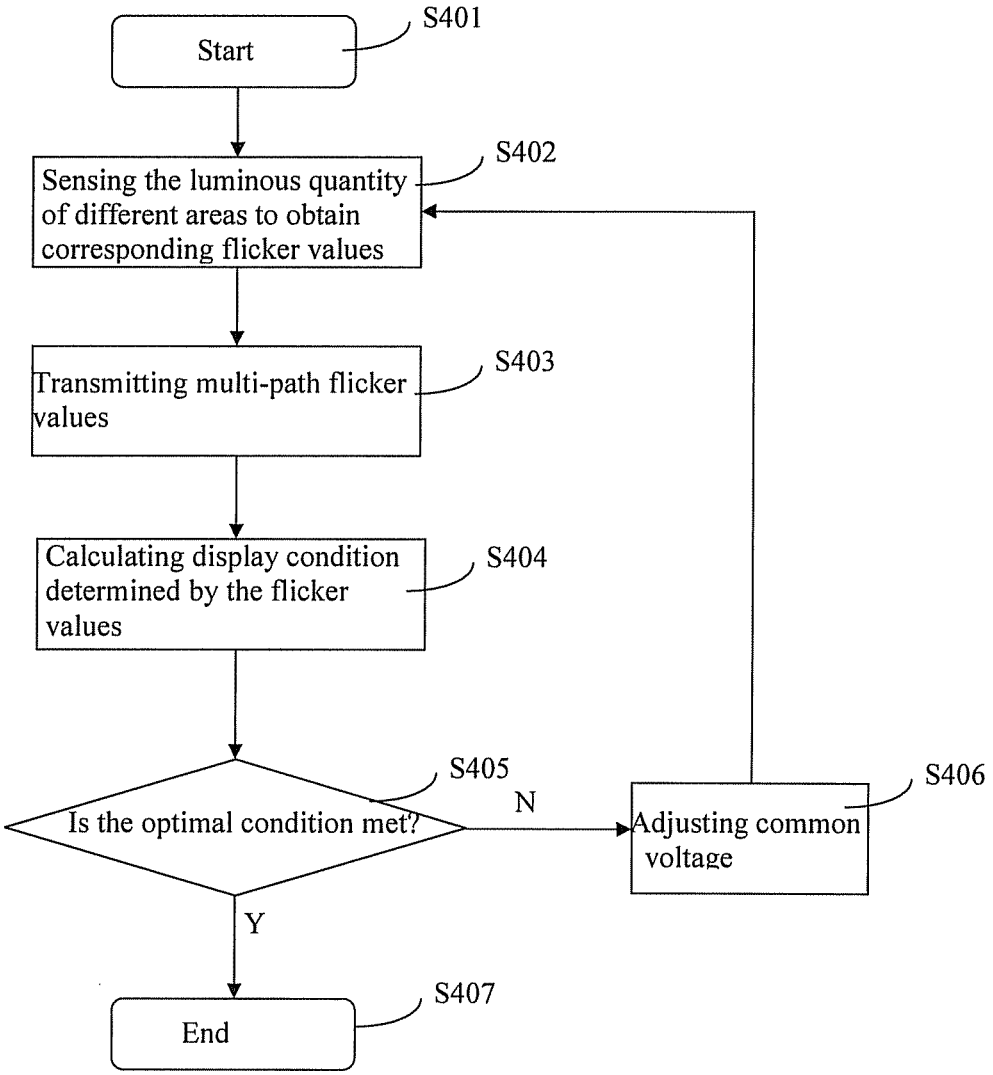
FIG. 4 shows a flow chart of a method for automatically adjusting common voltages according to the principle of the present disclosure.

FIG. 4 shows a flow chart of a method for adjusting self-adaptive Multi-area common voltage according to the principle of the present disclosure. The method starts at step S401. At step S402, luminous quantity from different areas is sensed, and then flicker values corresponding to the different areas are obtained and transmitted. In step S403, the flicker values corresponding to the plurality of areas are received, and one of the flicker values is transmitted in one moment.

In step S404, the sensed flicker values are continuously received in a time sequence, the display condition determined by the plurality of flicker values is calculated, and the display condition is compared with the optimal display condition so as to judge whether the optimal display condition is met or not.

In step S405, the current common voltage value is adjusted if the optimal display condition is not met (in step S406), and the current common voltage output value is remained unchanged if the optimal display condition is met, and the whole regulation process is ended in step S407.

When the comparison result indicates that the difference between the actual display condition and the optimal display condition exceeds the first preset value, the common voltage output value corresponding to the area with the maximum weight is first adjusted.

When the comparison result indicates that the difference between the actual display condition and the optimal display condition is less than the second preset value, the common voltage output value corresponding to the area with the minimum weight is first adjusted.

When the comparison result indicates that the difference between the actual display condition and the optimal display condition is between the first preset value and the second preset value, the common voltage output value corresponding to an area with a medium weight is first adjusted.

The above-mentioned operations are executed repeatedly until the actual display condition is matched with the optimal display condition or in a range approaching to the optimal display condition, and then a regulation stop instruction can be output to keep the output value of the common voltage steady.

Different weights are assigned to different areas on the display panel, and the display condition determined by the plurality of flicker values is calculated based on the weights. In one example, the value of the output common voltage is adjusted by changing the voltage value stored in a voltage buffer. The output common voltage can also be adjusted by changing the voltage values input to a common voltage driver circuit.

Although the embodiments disclosed in the present disclosure are described above, the foregoing contents are merely the embodiments adopted for facilitating understanding the present disclosure, rather than limiting the present disclosure. Any modifications and variations could be made to the implementation forms and details by any one skilled in the art to which the present disclosure pertains without departing from the spirit and scope disclosed in the present disclosure, but the scope defined by the claims is still subjected to the patent protection scope of the present disclosure.

What is claimed is:

1. A system of self-adaptively adjusting Multi-area common voltage, comprising:

a plurality of photosensitive devices, arranged near different areas of a display panel, for sensing luminous quantity from the different areas so as to obtain and transmit flicker values corresponding to the different areas;

a multiplexing element, connected with the plurality of photosensitive devices, for receiving the flicker values transmitted by the plurality of photosensitive devices and transmitting one of the flicker values at one moment;

a calculation and comparison unit, for continuously receiving the flicker values which are sensed by the plurality of photosensitive devices and transmitted by the multiplexing element in a time sequence, calculating actual display condition determined by the plurality of flicker values, and comparing the actual display condition with an optimal display condition, so as to judge whether the optimal display condition is met or not; and a common voltage adjusting and outputting unit, connected with the calculation and comparison unit, for adjusting the value of the current output common voltage if the optimal display condition is not met, and remaining the value of the current output common voltage unchanged if the optimal display condition is met;

wherein different areas of the display panel are assigned different weights, and the actual display condition determined by the plurality of flicker values is calculated according to the weights, wherein the actual display condition is calculated according to the following equation:

$$J = \sum_{i=0}^{M} W_i \times FLICKER_i$$

wherein J represents the display condition, $W_i$ represents the weight of area i, $FLICKER_i$ represents the flicker value corresponding to area i, and M represents the number of the areas formed by dividing the display panel.

2. The system of claim 1, wherein the common voltage adjusting and outputting unit comprises a common voltage buffer, for storing a common voltage value to be output and providing the value after digital-to-analog conversion to common electrode ends corresponding to the different areas of the display panel.

3. The system of claim 1, wherein when the comparison result indicates that the difference between the actual display condition and the optimal display condition exceeds a first preset value, the value of the output common voltage corresponding to an area with the maximum weight is first adjusted;

when the comparison result indicates that the difference between the actual display condition and the optimal display condition is less than a second preset value, the value of the output common voltage corresponding to the area with the minimum weight is first adjusted; and when the comparison result indicates that the difference between the actual display condition and the optimal display condition is between the first preset value and the second preset value, the value of the output common voltage corresponding to an area with a medium weight is first adjusted.

4. A method of self-adaptively adjusting Multi-area common voltage, comprising the steps of:

sensing luminous quantity from different areas to obtain and transmit flicker values corresponding to the different areas;

receiving the flicker values corresponding to the areas, and transmitting one of the flicker values at one moment;

continuously receiving the sensed flicker values in a time sequence, calculating a display condition determined by the plurality of flicker values, comparing the display condition with an optimal display condition, so as to judge whether the optimal display condition is met or not; and adjusting the value of the current output common voltage if the optimal display condition is not met, and remaining the value of the current output common voltage unchanged if the optimal display condition is met;

wherein different areas of the display panel are assigned different weights, and the actual display condition determined by the plurality of flicker values is calculated according to the weights, wherein the actual display condition is calculated according to the following equation:

$$J = \sum_{i=0}^{M} W_i \times \mathrm{FLICKER}_i$$

wherein J represents the display condition, $W_i$ represents the weight of area i, $\mathrm{FLICKER}_i$ represents the flicker value corresponding to area i, and M represents the number of the areas formed by dividing the display panel.

5. The method of claim 4, wherein the output common voltage is adjusted by changing the voltage value stored in the voltage buffer.

6. The method of claim 4, wherein the output common voltage is adjusted by changing voltage values input to a common voltage driver circuit.

7. The method of claim 4, wherein when the comparison result indicates that the difference between the actual display condition and the optimal display condition exceeds a first preset value, the common voltage output value corresponding to an area with the maximum weight is first adjusted;

when the comparison result indicates that the difference between the actual display condition and the optimal display condition is less than a second preset value, the common voltage output value corresponding to the area with the minimum weight is first adjusted; and when the comparison result indicates that the difference between the actual display condition and the optimal display condition is between the first preset value and the second preset value, the common voltage output value corresponding to an area with a medium weight is preferably adjusted.

* * * * *